United States Patent [19]

Boissier et al.

[11] Patent Number: 4,790,566

[45] Date of Patent: Dec. 13, 1988

[54] IDENTITY DOCUMENT DIFFICULT TO FALSIFY AND A PROCESS FOR MANUFACTURING SUCH A DOCUMENT

[75] Inventors: Alain Boissier, Marly le Roi; Alain Glatigny, Rueil Malmaison, both of France

[73] Assignee: Matra, Paris, France

[21] Appl. No.: 786,853

[22] Filed: Oct. 11, 1985

[30] Foreign Application Priority Data

Oct. 11, 1984 [FR] France ..... 84 15607

[51] Int. Cl.[4] ..... B42D 15/00

[52] U.S. Cl. ..... 283/91; 283/93; 283/904; 358/298

[58] Field of Search ..... 283/89, 90, 91, 92, 283/93, 94, 904; 358/298, 282

[56] References Cited

U.S. PATENT DOCUMENTS

| | | | |
|---|---|---|---|
| 3,977,007 | 8/1976 | Berry et al. | 283/93 |
| 4,342,051 | 7/1982 | Suzuki et al. | 358/298 |
| 4,365,275 | 12/1982 | Berman et al. | 358/298 |
| 4,389,712 | 6/1983 | Frattarola et al. | 358/298 |
| 4,491,875 | 1/1985 | Kawamura | 358/298 |
| 4,525,729 | 6/1985 | Agulnek et al. | 358/298 |
| 4,543,613 | 9/1985 | Sakamoto | 358/298 |

OTHER PUBLICATIONS

"New Gray Scale Printing Method Using a Thermal Printer"; Tokunaga, Y; Kubota, K; Ohya, J; *IEEE Transactions on Electron Devices* vol. Ed-30, No. 8, Aug. 1983, pp. 898–904.

*Primary Examiner*—Paul A. Bell

*Attorney, Agent, or Firm*—Larson & Taylor

[57] ABSTRACT

An identity document has graphical information printed on a support and including uncoded alphanumerical information which is specific to a holder of the document or to the document. The surface of the support is broken down into a network of macropixels each having a predetermined average light absorption level. Each of the micropixels in turn consists of a dot pattern matrix of micropixels each having a light absorption level selected among at least two predetermined levels and distributed for the average absorption of each of the macropixels to be said predetermined average light absorption level and for constituting a screen which reproduces on a microscopic scale part at least of the uncoded specific information.

9 Claims, 5 Drawing Sheets

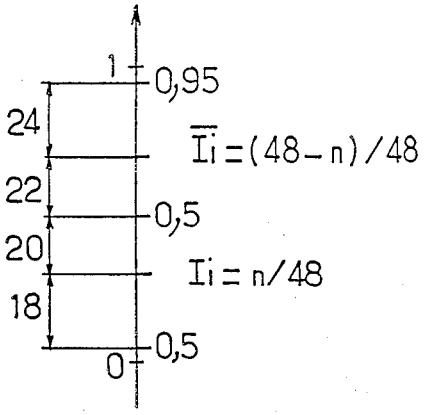
FIG. 5.
FIG. 7.
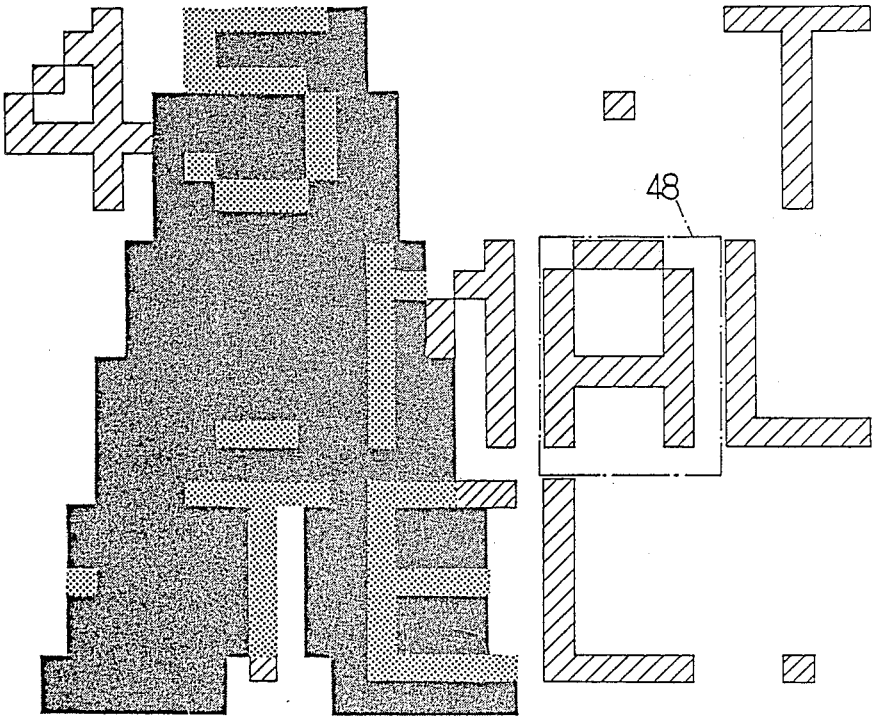

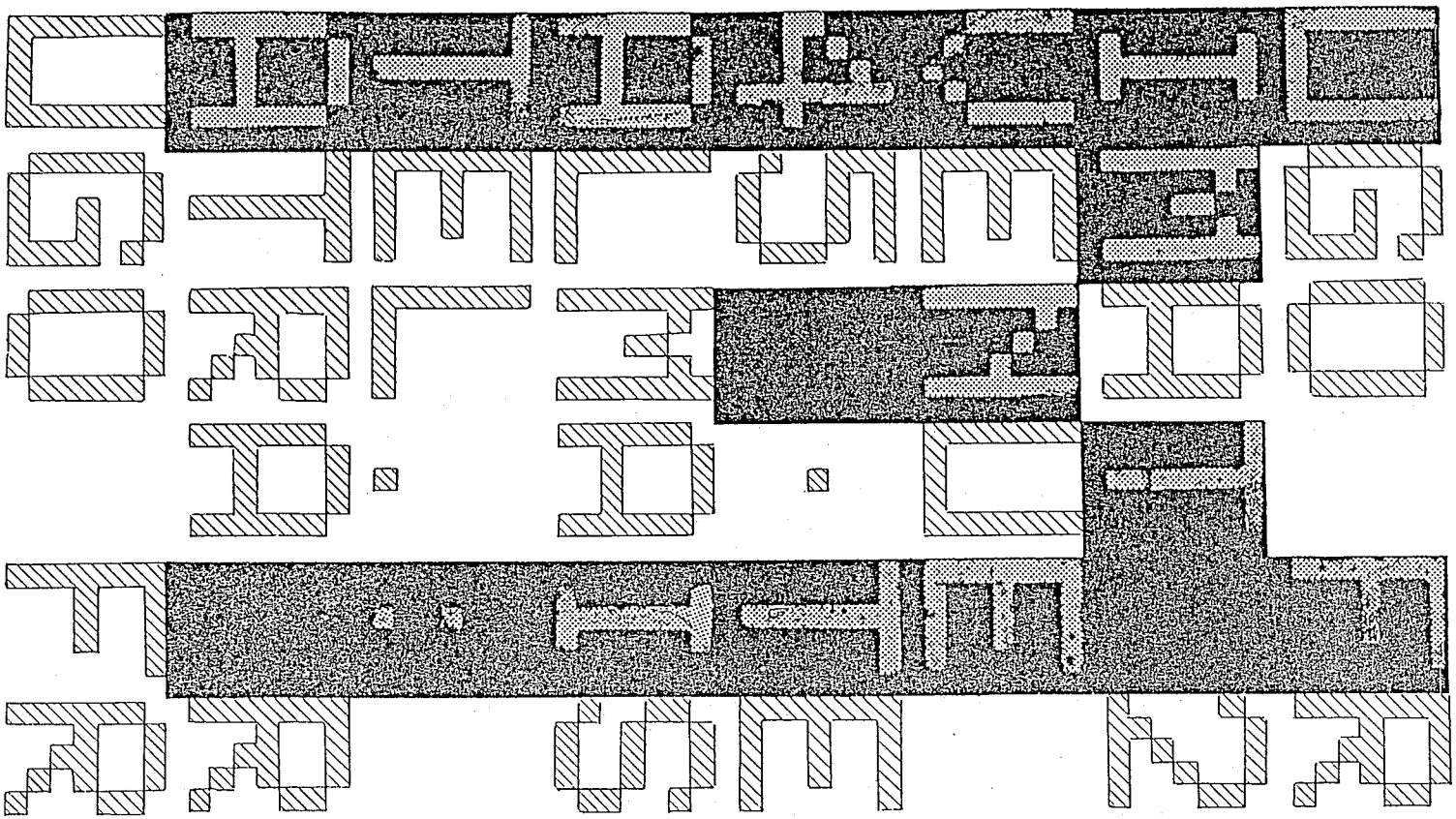
GO
GO
GO

IDENTITY DOCUMENT DIFFICULT TO FALSIFY AND A PROCESS FOR MANUFACTURING SUCH A DOCUMENT

TECHNICAL FIELD

The invention relates to identity documents of the type comprising alphanumeric information in clear language, specific to the holder and/or to the document, and often in addition a figurative part, on a screened background. A particularly important application is formed by documents such as identity cards and credit cards comprising information specific to the holder, some of which are alphanumeric (surname and christian names, etc.) and generally represented by signs materialized by two levels of absorption or reflection of light, i.e. a single contrast (black on white for example) and others are figurative (photographs for example) and represented by grey or half tone levels in number very much greater than two.

BACKGROUND OF THE INVENTION

A screened background is currently used for complicating the falsification of documents by scratching and substituting indications. But known screening techniques have drawbacks: either the screen is simple and very visible and in this case may be reconstituted or else it has a level of complexity which makes it practically impossible to check its condition by a simple visual examination of the document.

There exist a number of printing methods employing dot pattern matrices with only some density levels available for achieving printing with many grey levels, which however do not help in reducing the risk of tampering: reference may for instance be made to "New grey scale printing method using a thermal printer" in IEEE Transactions on Electron Devices, Vol. ED30 (1983), Aug. No. 8, New York.

SUMMARY OF THE INVENTION

It is an object of the invention to provide an identity document of the above-defined type whose screen, repetitive and covering the whole of the document, presents, with part at least of the alphanumeric indications on said document, a correlation preventing modification of said part without disappearance of the correlation, said disappearance being easily detected upon a short time visual examination.

According to the invention, a document of the above-defined type comprises graphic indications with at least two light absorption or density levels, the surface of the document being broken up into a network of macroscopic pixels (which will be designated as macropixels) each having a predetermined average absorption level, wherein each macropixel consists of a matrix of elementary pixels or "micropixels" each having an absorption or density level selected from at least two (and generally $2^p$, p being an integer greater than 1) levels and distributed so as to achieve said average absorption of each macropixel and further to form a pattern reproducing, on a microscopic scale, part at least of the indications specific to the document.

Tampering will destroy the correlation: if for instance the date of birth is modified on an identity document, the fraud will be detected by examining the screened background under the falsified characters, or by comparing an information (the date for example) represented by the macropixels with the corresponding information (which must be identical) reproduced by the micropixels in the frame. Such checking may be accomplished by using a magnifying glass, the micropixels forming alphanumeric indications which are then visible, on matrices of $5\times7$ micropixels of each 20 $\mu m\times20$ $\mu m$ for example.

When the identity document only comprises alphanumeric indications, it is generally sufficient to have four light absorption or density levels available for the micropixels, since the black micropixels of a letter or a figure always represents less than half of the micropixels of the matrix which represent it in black on white. Two levels (black on white or conversely) may even be sufficient in some cases. On the other hand, the figurative parts and more particularly photographs require between sixteen and sixty-four absorption levels (grey levels) in order to be acceptable. A contrast quantification scale must then be provided, for the micropixels, having a number of levels much greater than 2.

It can be seen that the invention involves representing each macropixel of an alphanumeric element visible to the naked eye with a matrix of microscopic alphanumeric characters whose average absorption is that of the macropixel whose contrast is selected among two absorption levels only. For that to be possible, two at least of the levels available for forming the micropixels (the extreme levels) must correspond respectively to light absorption levels higher and lower than those which belong to the absorption range which the macropixels may assume. If the micropixels have values from black (saturation) to white (paper brightness), the macropixels may only have "grey" values: in other words, the inscriptions will appear as dark grey on light grey, the dark grey being the same for all the graphemes of the same character in the screen.

In the case of graphic indications, such as a photograph, for which an extensive absorption dynamic range is required from black to white with half tones, in a first processing step the absorption dynamic range must be compressed in accordance with an arbitrary predetermined law, selected so as not to denature the images.

In am enbodiment of the invention, of advantage because it is relatively simple, each macropixel is composite, "contains" a microscopic alphanumeric character in the screen and forms a basic "brick" for forming alphanumeric characters. As a counterpart, the print resolution of these characters is then limited by the size of the macropixels, which will each represent for example $6\times8=48$ micropixels. Another solution, more complicated to put into practice but providing improved definition, consists in breaking each macropixel containing an alphanumeric screen character down into a plurality of micropixels having absorption levels selected to improve the definition of the document.

There is also provided a process for producing identity documents comprising alphanumeric information in clear language, and possibly figurative pictures, on a background screen or frame, characterized in that the dynamic range of contrast of the graphic information to be reproduced is compressed so as to reduce it to a contrast range lower than that which may be obtained at the micropixel level; the graphic indications are broken up into macropixels having a dimension greater than (or equal to) that of the micropixels; in each micropixel the optical density is determined which should be given to each micropixel for representing on a microscopic scale a frame character in each macropixel and for leaving its overall contrast unchanged, and the micropixels are printed on the document.

The invention will be better understood from the following description of particular embodiments of the invention, given by way of examples only.

BRIEF DESCRIPTION OF THE DRAWINGS

FIG. 5 is a graph showing a scale for determining the type of representation to be adopted for a frame character;

FIG. 6 shows, on an enlarged scale, a possible representation of the letter M after framing;

FIG. 7 shows a fragment of the letter A represented by framing in accordance with a modification of the invention;

DESCRIPTION OF AN EMBODIMENT OF THE INVENTION

Figure 1:
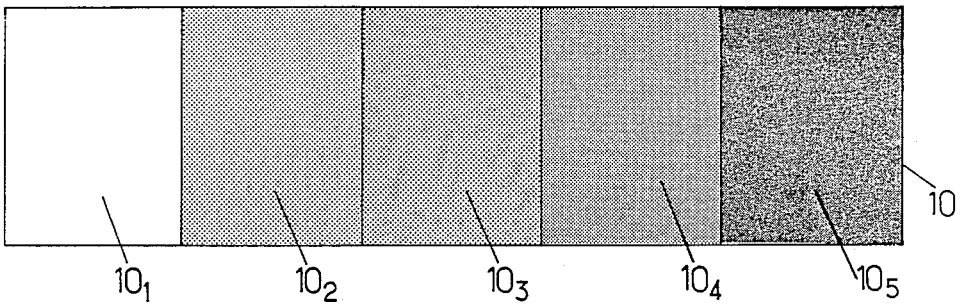
FIGS. 1 to 4 are diagrams respectively showing graphic indications to be reproduced on a document, formed by five macropixels disposed side by side; an example of a frame or screen to be inserted in the document; the macroscopic indications after contrast dynamic range compression; and the framed representation of the macroscopic indications on the document.

Before a complete description of the representation used by the invention in the most general case is given, a simple case will be considered, in which the macroscopic indications to be reproduced on the document are formed by five macropixels located side by side and having a regularly increasing light absorption from white to black. The five macropixels $\mathbf{10}_1$, $\mathbf{10}_2$, $\mathbf{10}_3$, $\mathbf{10}_4$, $\mathbf{10}_5$ may be considered as the initial image. They have been shown in FIG. 1 by adjacent rectangles. Due to the requirements in preparing patent drawings, black dots mutually spaced at variable distances indicate the successive grey levels. Each macropixel will be represented on the document by a matrix of $6\times8$ micropixels, each matrix representing an alphanumeric character of the frame, on a matrix of $5\times7$ micropixels. These characters of the frame reproduce a part of the alphanumeric indications represented by the macropixels on the document and so visible to the naked eye.

Figure 2:
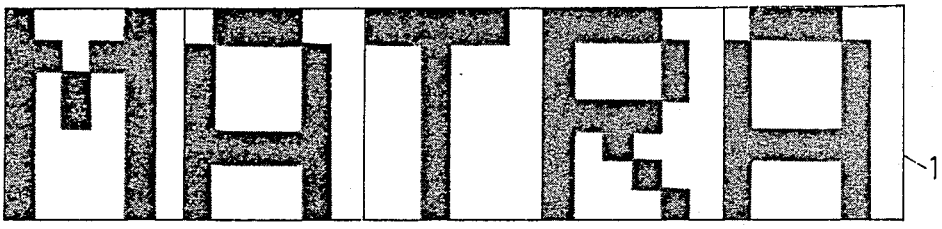

Referring to FIG. 2, the word MATRA is illustrated and will be readable repetitively on the frame.

Figure 3:
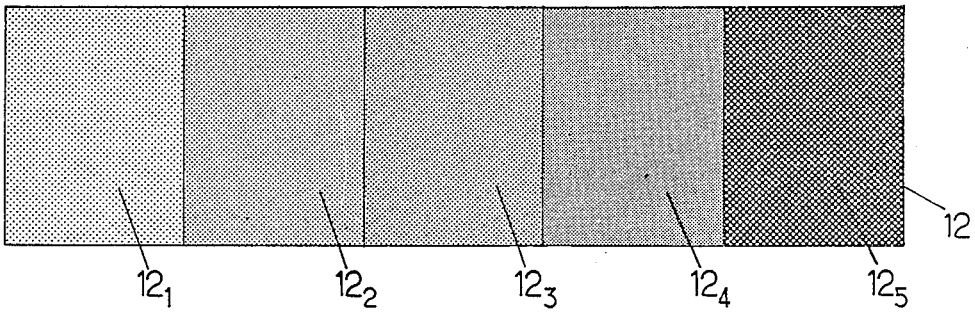
Figure 4:
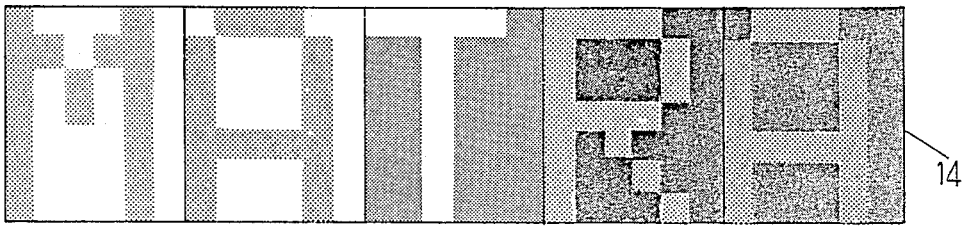

It is not possible to print an image which will appear to the naked eye as the initial image (FIG. 1) with density levels from white to black. It will be a corrected image (FIG. 3) having a reduced dynamic range, from a very light grey (macropixel $\mathbf{12}_1$) to a very dark grey macropixel $\mathbf{12}_5$). Under the magnifying glass, the macropixels 14 will appear, because of the screen or webbing, as shown in FIG. 4. Each micropixel matrix 14 will have the same average absorption rate as the corresponding macropixel 12 of the corrected image and will be formed from micropixels each having an absorption or density rate selected from n values which, as shown, are five in number, from white to black.

One possible method of compressing the light absorption contrast scale will now be described in more detail first of all and then the determination of the grey levels of the micropixels as a function of the alphanumeric character to be represented by the macropixel and as a function of the available quantification levels, from white to black. It should however be understood that the words "white", "black" and "grey" are only used here for the sake of convenience of the description and that the invention would also be applicable to a color document.

COMPRESSION OF THE LIGHT ABSORPTION SCALE

The first step in processing the graphic information, when the latter is available in a range from black to white, consists in modifying the dynamic range of the image so as to allow a complete frame or screen character to be written with a non-zero contrast inside one of the lightest and the darkest macropixels to be reproduced. If it is assumed that the light reflection level (grey value) Ii of each micropixel is between 0 and 1:

0=black dot

1=white dot the dynamics of the grey levels must be modified so that the scale only extends between two intermediate values, for example $I'i_{min}=0.05$ replacing Ii mini=0

$I'i_{max}=0.95$ replacing Ii max=1.

The law causing the grey level I'i in the transformed scale to correspond to the original level Ii may be:

$$I'i = \frac{Ii - Ii_{min}}{Ii_{max} - Ii_{max}} \times 0.9 + 0.05$$

Each macropixel, whether it belongs to an image or to an alphanumeric character, will thus have a grey level which will never reach white or black (while a micropixel may on the contrary be printed white or black).

FRAMING OF THE MACROPIXELS

Each macropixel, of a given optical density or reflection level, is then represented by a character formed by micropixels having one or other of the two optical reflection levels on a predetermined matrix. The micropixels have a dimension such that they are not perceptible to the naked eye. Since the shape of the frame character is imposed, the available parameters are:

the common grey level of all graphemes in the character, the grey level of the background on which the graphemes appear.

The condition to be fulfilled is that the average optical reflection value is equal to I'i.

The particular case will be considered in which each macropixel consist of $m=6\times8$ micropixels and where this macropixel contains an alphanumeric character.

It is necessary first of all to determine which is the grey level of the macropixel, i.e. of the character to be represented which may be written as dark on light (positive contrast) or as light on dark (negative contrast).

If the graphemes comprise n micropixels and if these latter are black, the mean grey level will be:

$$Ii=n/i$$

In negative contrast, with the graphemes written as white on black, the mean grey level will on the contrary be:

$$Ii=(m-n)/m$$

In the case for example of the letter A (FIG. 2) the graphemes represent n=18 micropixels in a matrix of m=48 micropixels.

For each frame character to be represented, a scale may thus be established of the type shown in FIG. 5, in which appear the mean grey levels 0.05 and 0.95 which correspond to the grey limits of the macropixels to be represented, and the values Ii and Ii characterizing the frame character to be placed in the macropixel.

The method of representing the frame character. by means of two levels from several which are available (and which go from black to white) will then depend on that one of the ranges 18, 20, 22 and 24 (FIG. 5) in which is situated the main grey level of the macropixel to be represented.

First case:

range 18 (very dark macropixel)

Starting in this case with the character written with negative contrast (on black background) the graphemes are lightened so as to bring the mean grey level of this webbed macropixel to the value I'i. In the case of a matrix with n=48 micropixels, a contrast I of the character on a black background is obtained by giving to the grey level of the graphemes the value:

$$1-48\frac{(Ii-I'i)}{n}$$

that is to say for the letter A:

$$\frac{48I'i}{18}$$

Thus we have a representation of the letter A of the kind shown for the last letter of the word MATRA in FIG. 4.

Second case:

range 20

Starting again with the character written with negative contrast the background is lightened to which a defined grey level is given by the formula:

$$\frac{I'i-Ii}{48-n}\times 48$$

The contrast of the character is then 1−I.

Third case:

range 22

Starting this time with the character written with positive contrast the background is darkened so as to darken the macropixel.

The grey level of the elementary pixels of the background will be chosen at the value:

$$1-\frac{Ii-Ii}{48-n}\times 48$$

Fourth case:

range 24 (very light macropixel)

Starting with the character written with positive contrast the graphemes are lightened. The grey level of the elementary pixels of the character is chosen equal to:

$$\frac{Ii-Ii}{n}48$$

The contrast of the character is then 1−I

The representation is then of the kind shown for the first letter A in FIG. 4.

Figure 6A:
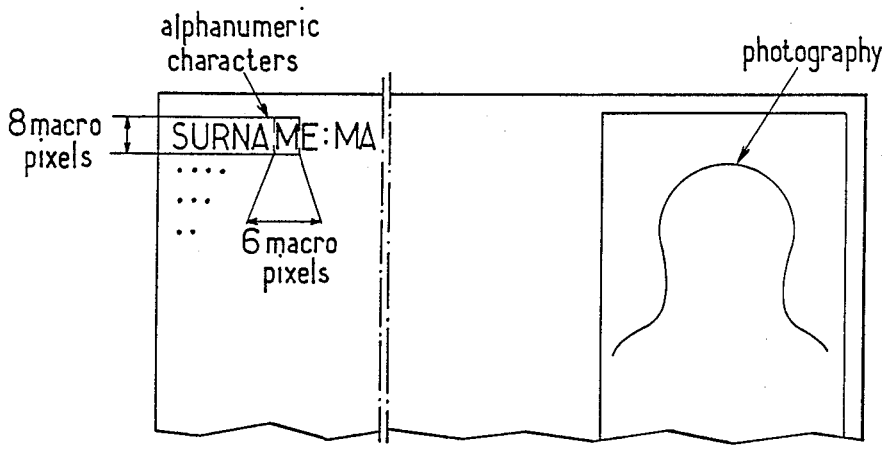
FIG. 6A is a schematic representation of an identity card having a support on which a photograph and alphanumeric information (partially represented) are printed, the letter M in a dotted frame being as shown in FIG. 6.

The result of framing of the document appears in FIG. 6, which shows on a larger scale the representation obtained of the letter M in the card of FIG. 6A which, from black on white in the original document has been transformed into a letter in which the graphemes appear as dark grey on a light grey background, at least to the naked eye. Each of the macropixels of the 6×8 matrix occupied by the letter and by the space between two successive letters contains a frame character, dark grey on a black background in the case of the macropixels of the graphemes, very light grey on a white background for the background. The characters of the frame reproduce, on a microscopic scale, those which appear on the document as a whole. In particular the word "MATRA" and address fragments reappear.

FIG. 7 shows a fragment of the letter A such as it is represented by framing in accordance with a variant of the invention. In the embodiment shown in FIG. 7, the macropixels are reduced to the size of macropixels, instead of each being formed for example from 48 micropixels such as the one shown at 48. The definition is then very much improved, which is particularly interesting for reproducing figurative parts. It may in particular be noted that each letter intended to be visible to the naked eye is coded over 30×48 micropixels.

On the other hand, it becomes more difficult to calculate the grey levels of the micropixels after framing, if the mean grey levels, calculated in groups of pixels, are to remain unchanged after framing.

To avoid excessive complication in this case it may then be sufficient to modify the grey level of the dots forming the frame (micropixels) by adding or subtracting a constant value to or from the grey level of the corresponding pixel. The operation is an addition or a subtraction depending on whether the grey level of the pixel of the initial image is less than 0.5 or greater than 0.5.

By way of example, it may be mentioned that satisfactory results are obtained when the document (identity card for example) is formed from micropixels of 20×20 μm each macropixel being formed from 6×8 micropixels and each readable alphanumeric character occupying 6×8 macropixels, generally, a height for an alphanumeric or graphic character between 1 and 5 mm will be satisfactory.

To avoid unauthorized reproduction of the document by photography, as carrier medium a water marked paper may be used or a water mark may be included inside a plastic protection for the document, to the extent where this protection cannot be removed from the document without irreversibly damaging the latter. Moreover, colored documents may be obtained by different techniques, particularly the use of a color sensitive carrier, the use of a preprinted document with colored ranges and patterns and the use of a plastic protection on which transparent colored areas are silk screen printed.

The manufacture of the document which has just been described may be provided by different methods. However, these methods generally comprise a series of common steps:

drawing up of a docket containing the alphanumeric indications and the supply of a photo by the candidate, or else direct introduction of the alphanumeric data by the operator and taking a photograph on the spot, the whole of the data being in any case digitized and stored on the same storage medium, generation of the micropixels by a high speed computer which must calculate the mean value of the macroscopic pixels, generate the frame and calculate the values of the micro pixels in real time in accordance with a given algorithm and to control the printing, printing by a high speed system, which will generally comprise a rotary prism and a laser beam modulated by acousto-optical means.

Considering the high cost of the printing apparatus properly speaking, it will often be useful to split the manufacturing device into two parts. The first part is formed by an apparatus for data acquisition, for digitization of the information and storage on a transportable medium. The second part is formed by the calculating and printing apparatus. This latter apparatus, operating in deferred time may process the storage media coming from a large number of data acquistion apparatus.

Figure 8:
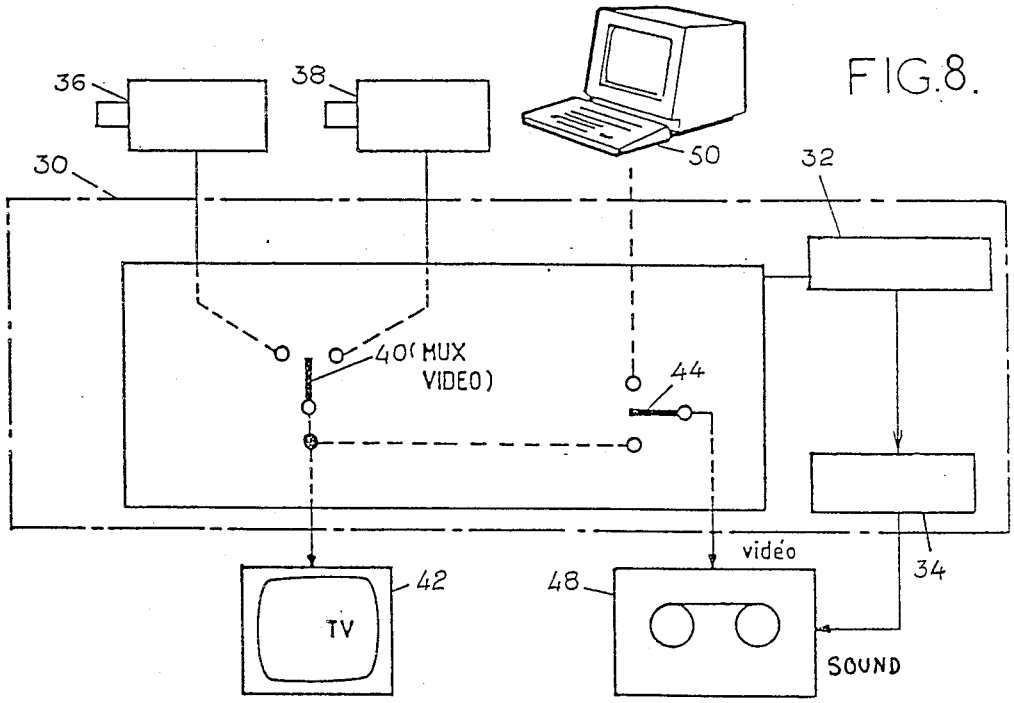
FIG. 8 is a general block diagram of a data acquisition apparatus for implementing the process of the invention.

FIG. 8 shows by way of example one possible construction of a data acquisition and recording apparatus, useful more especially for establishing identity cards.

The apparatus whose general construction is shown in FIG. 8 forms an independent terminal, one unit of which may be set up in each administrative center for collecting the information at the source. The apparatus of FIG. 8 comprises a control means 30 comprising a microprocessor 32 and a character generator 34, connected to input/output means. In general, these means will comprise more especially those which will now be described.

The control means is connected to two video cameras 36 and 38 provided respectively for supplying an image of the face and of the fingerprints of the applicant. A video multiplexer 40 allows one or other of the images supplied by cameras 36 and 38 to be displayed on a television monitor 42. A second multiplexer 44 allows the information supplied by the cameras and those coming from an operator consul 50 having a data input keyboard to be directed to a storage means 48, shown in the form of a video tape recorder. If a video tape recorder is used, the images are advantageously recorded in the video track, whereas the alphanumeric information coded by the character generator 34 are simultaneously recorded in the sound track.

The apparatus may be completed by a printer which supplies a copy of the information recorded by the operator and which may be validated by the applicant, for example by affixing his signature or a finger print. A badge reader may also be provided which allows data to be introduced only by an operator who has previously introduced his identification badge and typed on the keyboard a password known only by himself.

The recording thus obtained may then be transported for use by the pixel generation and printing apparatus.

This apparatus may have the general construction shown in FIG. 8, numerous other constructions being possible.

Figure 9:
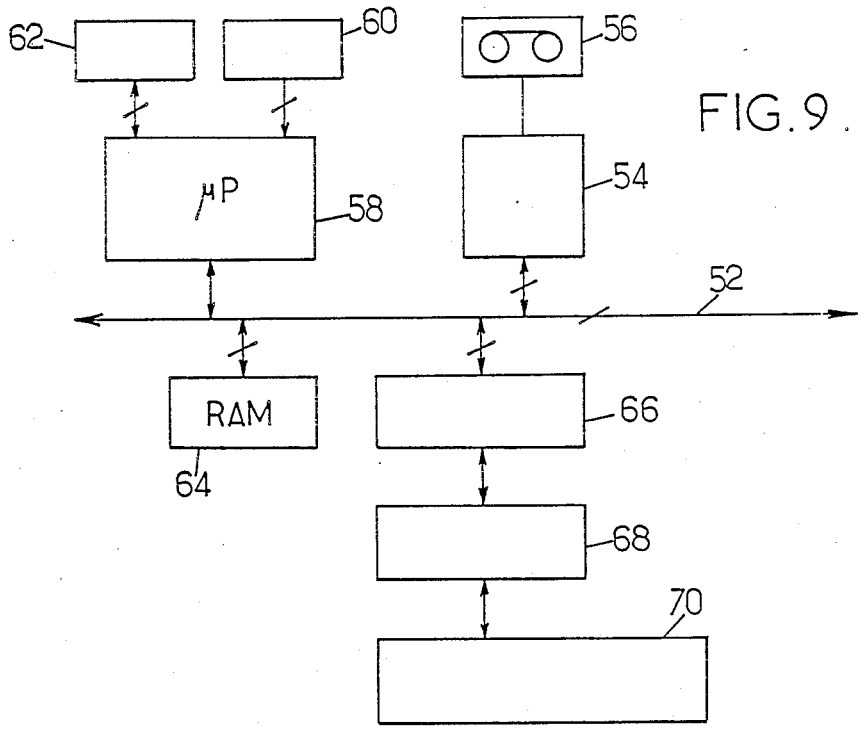
FIG. 9 is a block diagram of a pixel generation and printing apparatus for implementing the invention.

The apparatus shown schematically in FIG. 9 comprises a bus 52 to which input/output means and processing means are connected. When the apparatus is intended to receive the information in the form of a video tape recording, the apparatus comprises a video tape recorder interface 54 connected to the video tape recorder 56. A microprocessor card 58 also connected to the bus processes the data introduced by means of an operator keyboard 60 and restores the information to be kept on a display means, such as a printer 62. The information relating to a document to be produced read by the video tape recorder 56 is stored in a random access memory 64. A capacity of 256 K 8 bit bytes is generally sufficient for storing all the information corresponding to an identity card.

The means for determining the frame, i.e. the grey level to be given to each micropixel, comprise an address sequencer 66 having a buffer RAM. This buffer memory will store the text which is to be reproduced repetitively in the frame, formed of 256 8 bit bytes at maximum, coded in binary form and the available grey levels going from black to white, coded over 8 bits for example.

The sequencer receives this time from the microprocessor 58 on the other hand the line and column indications of each micropixel in succession and, on the other hand, the parameters chosen for the realisation. The sequencer is driven by a clock which gives the printing rate of the successive dots and defines the content of the frame associated with each line of micropixels in its turn. A correspondance table addressable by the sequencer will allow the value of the micropixels corresponding to each line to be supplied to the restitution apparatus 70 which may be either of the direct paper printing type or of the photographic type.

The method used is then the following one: whenever the elements of a new card to be produced appear, the microprocessor card loads the characters of the text to be inserted in frame form in the RAM of 256 alphanumeric characters, at the same time as the value of the parameter indicating the length of the frame text. The operation will then take place at a timing fixed by a clock incorporated in the restorer 70. This clock supplies pulses at the rate of printing the dots of a line and line return pulses. The line return pulses are spaced apart by values such that only a part of the line duration is used for transmitting information concerning the micropixels to be printed. During this time of the length of a line, the data transmitted to the restorer 70 are written onto the medium, for example the paper. The remainder of the time is ignored by the restorer. It is used by the microprocessor card which controls the system. During this duration of the line period, the microprocessor card loads into the sequencer:

the scale of the grey levels, the dimensions of the matrix defining the characters of the frame (i.e. the number of micropixels in a macropixel, in a horizontal directon and in a vertical direction)

the commands required by the sequencer, preloading of the frame text counter, for controlling the organization of the frame in the horizontal direction and the vertical direction.

With such as basic software control, the following can be readily modified:

the organization of characters, with the associated definition (number of micropixels in a macropixel), the size of the identity card to be produced, the definition of the image, since the grey levels which form it are updated at each micropixel line, the definition of the characters visible to the naked eye, independently of the character organization forming the frame.

The correspondance table 68 is provided for determining the video signal of the restorer 70 responsive to several parameters which are:

the mean grey level of the card at a given position, i.e. for given macropixels, the parameters defining the characters of the web or screen (i.e. the dimensions of the characters as a number of micropixels), the type of founts to be printed.

This table will consequently be of a large size, if a large number of grey levels and a large number of different characters are desired. If for example it is desired to have sixty-four different grey levels, so as to have good reproduction of the figurative parts and so as to restore not only the latin characters but also other characters (for example arabic), a table of 500 k words may be necessary. This table may consist of PROM receiving at its input a code representative of the character (seven bits), a code representing the mean grey level (six bits) and a code representing the type of founts (six bits). The table outputs in sequence, over six bits in the case where sixty-four grey levels are available, a signal representative of the absorption of the successive micropixels.

Numerous modifications are possible. Documents may be printed in characters other than latin characters (the same machine being able to print alternately several types of characters of several arrangements). The document produced may have a frame which is coded according to a code so simple that a very rapid verification with a pocket computer programmed with the decoding key may be made.

What is claimed is:

1. Identity document having a support and graphical information printed ion said support, said graphical information including uncoded alphanumerical information visible to the naked eye and which is specific to a holder of said document or to said document, wherein the graphical information consists of a network of a large number of macropixels each having a specific light absorption, and wherein each of said macropixels consists of a dot pattern matrix of macropixels each having a light absorption selected among at least two predetermined light absorptions, whereby the light absorption of the macropixel is equal to the sum of the light absorptions of the micropixels in the matrix, the micropixels having different ones of said predetermined light absorptions in the same one of said matrices and being distributed for reproducing part of said uncoded specific information on a microscopic scale in a directly readable form.

2. Identity document according to claim 1, wherein each of said macropixels consists of a dot pattern matrix of micropixels in sufficient number for representing an alphanumeric or graphic character of said screen within each macropixel.

3. Identity document according to claim 1, wherein said alphanumerical information consists of macropixels which are broken up into micropixels having predetermined light absorption levels selected for improving the definition of said graphical information.

4. Identity document according to claim 1, wherein each of said alphanumeric or graphical character of said screen is represented on a dot pattern rectangular matrix wherein each of said dots is a micropixel and wherein each alphanumeric or graphical character is eye readable and corresponds to the surface of a plurality of alphanumeric or graphical character is eye readable and corresponds to the surface of a plurality of alphanumeric or graphical characters in said screen, with a height which is of from 1 to 5 millimeters.

5. Identity document according to claim 1, wherein each of said alphanumeric characters of the screen is represented within one macropixel as a line of micropixels having a predetermined light absorption level, whereby each macropixel consists of micropixels whose light absorption is selected among three light absorptions only.

6. Identity document according to claim 5, wherein the light absorption levels available for constituting said macropixels are selected among a set of from 4 to 64 light absorption levels, extreme ones of said absorption levels being white and black, and wherein the graphical information carried by said document are in half tone from very high degree to very dark grey.

7. Identity document having graphical information printed on a support and including uncoded alphanumerical information which is specific to a holder of said document or to said document, wherein said graphical information consists of a large plurality of macropixels each having a specific average light absorption level such that all of the macropixels represent the graphical information on a macroscopic scale, and wherein said macropixels each consist of a dot pattern matrix of micropixels each having a light absorption level selected among at least two predetermined levels, the sum of the light absorption levels of the micropixels in the matrix being equal to the light absorption level of the respective macropixel, the whole of said matrix repetitively reproducing on a microscopic scale part at least of said alphanumerical specific information, whereby correlation between reproductions of said specific information on a macroscopic scale and on a microscopic scale is achieved.

8. Identity document having a support and uncoded alphanumerical characters and pictures which are specific to a holder of said document on a surface of a support, wherein said alphanumerical characters and pictures are printed on said surface as micropixels each having a light absorption level selected among a plurality of predetermined levels from white to black;

said micropixels are distributed into multiple adjacent rectangular matrices each forming a macropixel consisting of micropixels having only two levels among said plurality of levels, distributed to form, on a microscopic scale, an alphanumerical character;

the two levels of the micropixels in a macropixel are selected for the average absorption of said macropixel to represent an element of said alphanumerical characters and pictures having a light absorption level selected among a plurality of more than two predetermined values from light grey to dark grey;

and wherein the alphanumerical characters represented on a microscopic scale within said macropixels reproduce at least part of said uncoded alphanumerical characters in directly readable form.

9. A process for manufacturing an identity document having a graphic image including alphanumeric characters representing information in clear language and a background screen printed on a same support, comprising the steps of:

compressing the dynamic range of contrast of an original graphic image to be reproduced to reduce it to a contrast range lower than that which may be obtained as printed micropixels of predetermined size;

breaking down the graphic image up into macropixels having a dimension greater than that of the printed micropixels and each including the same predetermined plurality of micropixels;

computing the optical density to be given to each micropixel in each of said macropixels for representing on a microscopic scale one of a plurality of characters a screen correlated to said information and for leaving the overall contrast of the macropixel unchanged, and printing the micropixels on the support.

* * * * *